US006722099B2

(12) United States Patent
Gilbert et al.

(10) Patent No.: US 6,722,099 B2
(45) Date of Patent: Apr. 20, 2004

(54) CONCRETE FORM ASSEMBLAGE PROCESS AND FORM TIE EXTENDER THEREFORE

(76) Inventors: Dale A. Gilbert, 203 Woodland Dr., Wallace, ID (US) 83873-2427; Carl L. Blalack, 11084 S. Hardy Creek Rd., Cataldo, ID (US) 83810

( * ) Notice: Subject to any disclaimer, the term of this patent is extended or adjusted under 35 U.S.C. 154(b) by 121 days.

(21) Appl. No.: 10/032,439

(22) Filed: Dec. 31, 2001

(65) Prior Publication Data

US 2003/0205659 A1 Nov. 6, 2003

(51) Int. Cl.[7] ..... E04G 21/00; E04G 17/06

(52) U.S. Cl. ..... 52/745.09; 249/40; 249/190; 249/213

(58) Field of Search ..... 249/40, 41, 42, 249/43, 44, 45, 46, 190, 196, 213, 214, 215, 216, 217, 218; 52/745.09

(56) References Cited

U.S. PATENT DOCUMENTS 1,712,876 A * 5/1929 Dolezal ..... 249/213
2,074,460 A 3/1937 Colt
2,646,703 A * 7/1953 Erbe ..... 249/213
2,726,432 A * 12/1955 Lemma ..... 249/46
3,612,473 A 10/1971 Franklin
3,633,867 A 1/1972 Eriksson
3,993,282 A 11/1976 Berman et al.
4,159,097 A 6/1979 Strickland
4,197,783 A 4/1980 Lancelot, III et al.
4,221,357 A 9/1980 Bowden et al.
5,657,601 A * 8/1997 Bean et al. ..... 249/214

* cited by examiner

*Primary Examiner*—Michael Safavi
(74) *Attorney, Agent, or Firm*—Keith S. Bergman

(57) ABSTRACT

An elongate form tie extender aids insertion of form ties in form panel structures for thinner concrete walls. The extender passes through form tie holes and has fastening structure at one end to interconnect a form tie. For use a first form panel is established in forming position and form ties are fastened therein extending toward a second panel established in a temporary position spaced to allow a workman to move between the panels. Form tie extenders are interconnected on form ties in the first panel with one end in paired cooperating form tie holes in the second panel. The second panel is moved to forming position adjacent the first panel with form ties extending between the panels. The form tie extenders are removed and the form ties fastened on the second panel.

2 Claims, 4 Drawing Sheets

38a
39a
22b
37a
29
28
30a
41b
21b
43c
43b
26b
27
24
20
49
51
50
25
30
26b 44a
23
44b
26
22
23
27
20
21
32
46
22
45
25
35
44
20
32
44
46
47
19
48
19
44b
44a

CONCRETE FORM ASSEMBLAGE PROCESS AND FORM TIE EXTENDER THEREFORE

BACKGROUND OF INVENTION

RELATED APPLICATIONS

There are no patent applications related hereto heretofore filed by either or both of the instant inventors in this or any foreign country.

FIELD OF INVENTION

This invention relates generally to a process for creating forms for concrete walls, formed between spaced form panels having form ties extending through and between the panels, by using elongate form tie extenders.

BACKGROUND AND DESCRIPTION OF PRIOR ART

In the construction of relatively thin, at least somewhat vertical, poured concrete wall panels between spacedly adjacent forms of some areal extent, it has become common in creating form structures for such purpose to use modular form panels with elongate form ties extending between, through and externally of the form panels so that the form ties may be fastened on external surfaces of the opposed form panels to aid support and positional maintenance of the panels. Form ties have long been known for this purpose, their developmental history is long and the ties have become quite sophisticated with several distinct types of ties in common use in the present day concrete arts for particular purposes or benefits. All such ties, however, share common features of an elongate configuration, such as a rod or twisted wire bodies having substantial tensile and some compressive strength, and end portions providing fastening structure for fastening on the exterior surfaces of interconnected form panels, such as enlarged heads, loops or stops. One common and widely used form tie of the present day concrete forming arts provides an elongate steel rod having enlarged heads at each end and a length predetermined for fastening of the heads by wedge type fasteners against the outer surfaces of opposed form panels spaced at a particular predetermined distance. Another common type of form tie used especially in light frame construction provides an elongate twisted wire body with loops and stops at each end to allow fastening on the exterior surface of form panels by rod or wedge-type fasteners passing through the loops.

To use these or similar form ties, however, requires placement of the tie ends from the inside surfaces of the form panels through holes defined in the opposed panels. This in the past has constituted a difficult and time consuming process which the instant invention seeks to simplify and shorten.

Since concrete structures that commonly embody form ties usually are relatively thin and of substantial areal extent, the form panels that create the opposed formed surfaces of such concrete structures must be spaced correspondingly close together, commonly at distances of about four to sixteen inches. In the past when form structures of this type have been constructed, the form panels have been established in place on preformed footings or similar supports established to permanently support the concrete structure to be formed. Form ties then are established in proper position through and between the panels. Depending upon the nature of the form ties they generally have been inserted in predefined holes from the inside of a first form panel, through that panel and spacedly outwardly thereof where they are fastened before placement of the second adjacent form panel. The second panel then has been positioned spacedly adjacent the first panel and the ties inserted from the space between the panels through holes predefined in the second panel and therebeyond so that the second end of the ties may be fastened in place. Some ties may be inserted from the space between pre-positioned panels, especially with some deformation of the tie or use of large tie holes in the panels, but normally this is more difficult, time consuming and less effective than inserting the ties in the first panel before the second panel is moved into spacedly adjacent forming position.

In either case, the pre-positioned form panels for most wall structures are close enough together as not to allow a workman to position himself or effectively move his body therebetween, so the prior tie insertion process required insertion of at least one end of each tie in at least one form panel to be accomplished from exteriorly of the opposed pre-positioned form panels and at a distance from the hole to carry the tie, which is difficult and time consuming. To exacerbate the problem, if tie holes defined in form panels are enlarged to aid tie insertion, they tend to allow exit of substantial amounts of plastic concrete which may make subsequent form removal difficult and create a wall with irregular protuberances. This problem may be further exacerbated by reason of the fact that the ends of ties commonly define or carry enlarged fastening structures that require a hole for their insertion somewhat larger than the tie body. Generally the insertion of ties in a form structure heretofore has required the efforts of at least two workers, even with the use of elongate tools, as normally one worker has moved the tie from exteriorly of the first panel initially carrying it and a second worker has aligned the second tie end that is to be inserted in the second panel to direct the second tie end into the cooperating hole defined in the second adjacent panel.

Our invention simplifies this process by providing particular elongate form tie extenders releasably fastenable for support at the second end of each form tie and a modified method or process for form assemblage that allows the insertion of ties in the second form panel by a single worker moving in the space between two temporarily spacedly adjacent form panels before closer final positioning of the second form panel to form the finally assembled form structure.

These extenders and our process allowed by their use permit form assemblage by one worker rather than two in the same or less time than heretofore was required by two workers to accomplish the assemblage by prior traditional methods.

SUMMARY OF INVENTION

Our form tie extender provides an elongate rod-like body having connecting structure at one end to releasably interconnect the fastening structure of one end portion of a form tie. The connecting structure may take various forms to interconnect particular form ties, but neither the connecting structure nor the body of the tie extender are larger in cross section than form tie holes predefined in form panels to be serviced, thereby allowing elongate passage of the extender through the form tie holes. The extender has a length such that when an interconnected form tie and extender are carried in cooperating form tie holes defined in spacedly opposed form panels before final positioning, a worker may position himself and effectively move in the space between those form panels.

To use our form tie extender, a first form panel is established in a forming position on an underlying permanent support for a concrete structure to be formed. Form ties are inserted by a worker from the inner surface through the form tie holes in the first panel and spacedly beyond the outer panel surface where they are fastened by appropriate fasteners heretofore used for such purpose. The second form panel then is positioned in a temporary position spacedly adjacent the first panel at a distance somewhat less than the combined length of a form tie and interconnected form tie extender, but sufficient to allow a worker to move between the form panels. The first outer ends of the form tie extenders then are sequentially positioned by a worker between the form panels in cooperating form tie holes pre-defined in the second form panel and the second inner end of each extender is releasably interconnected with the form tie to be carried in that cooperating hole. When all form ties in a particular panel are assembled in this fashion with form tie extenders, the workman exits from between the panels. The second form panel then is moved into forming position on the permanent support spacedly adjacent the first panel so that the form tie extenders and the end portions of interconnected form ties pass through the cooperating form tie holes defined in the second form panel. The extenders then are removed from the interconnected form ties and the form ties fastened on the outer surface of the second form panel in traditional fashion to complete the form structure as heretofore known for forming the desired concrete structure.

In providing such a concrete forming system, it is:

A principal object to create an elongate form tie extender that may be releasably interconnected with the end portion of a form tie to create a combined assemblage of sufficient length to allow a space between adjacent form panels during the form assemblage process that is of sufficient size to allow passage and effective motion of a worker therein when the outer end portions of the interconnected form ties extenders are carried in cooperating form tie holes defined in adjacent form panels.

A further object is to provide such a form tie extender that has connecting structure to allow releasable interconnection with various form ties of the present day concrete forming arts, but yet is of such size as to pass through traditionally sized holes for the form ties defined in commercially available form panels.

A further object is to provide a form assembly process for use with such form tie extenders wherein a first form panel is established in forming position on a permanent support; form ties are inserted through holes pre-defined in the first panel and fastened on the outer side of the panel; a second form panel is established in temporary position spacedly adjacent the first form panel at a distance to allow a worker to pass and effectively move between the form panels; form tie extenders are established in cooperating holes defined in the second form panel and releasably interconnected with form ties projecting through the first panel and into the space between both panels; the second form panel is moved to forming position spacedly adjacent the first form panel while the interconnecting pairs of form ties and form tie extenders remain in the holes initially carrying them; removing the form tie extenders from the associated form ties outside the second form panel and fastening the form ties on the outer side of the second form panel.

A still further object is to provide a form tie extender and method for its use that are of new and novel design, of rugged and durable nature, of simple and economic practice and well adapted to the uses and purposes for which they are intended.

Other and further objects of our invention will appear from the following specification and accompanying drawings which form a part hereof. In carrying out the objects of the invention, however, it is to be remembered that its accidental features are susceptible of change in design and arrangement with only the best known mode of preferred and practical embodiments being illustrated and specified as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figures 1, 2, 3, 4, 5:
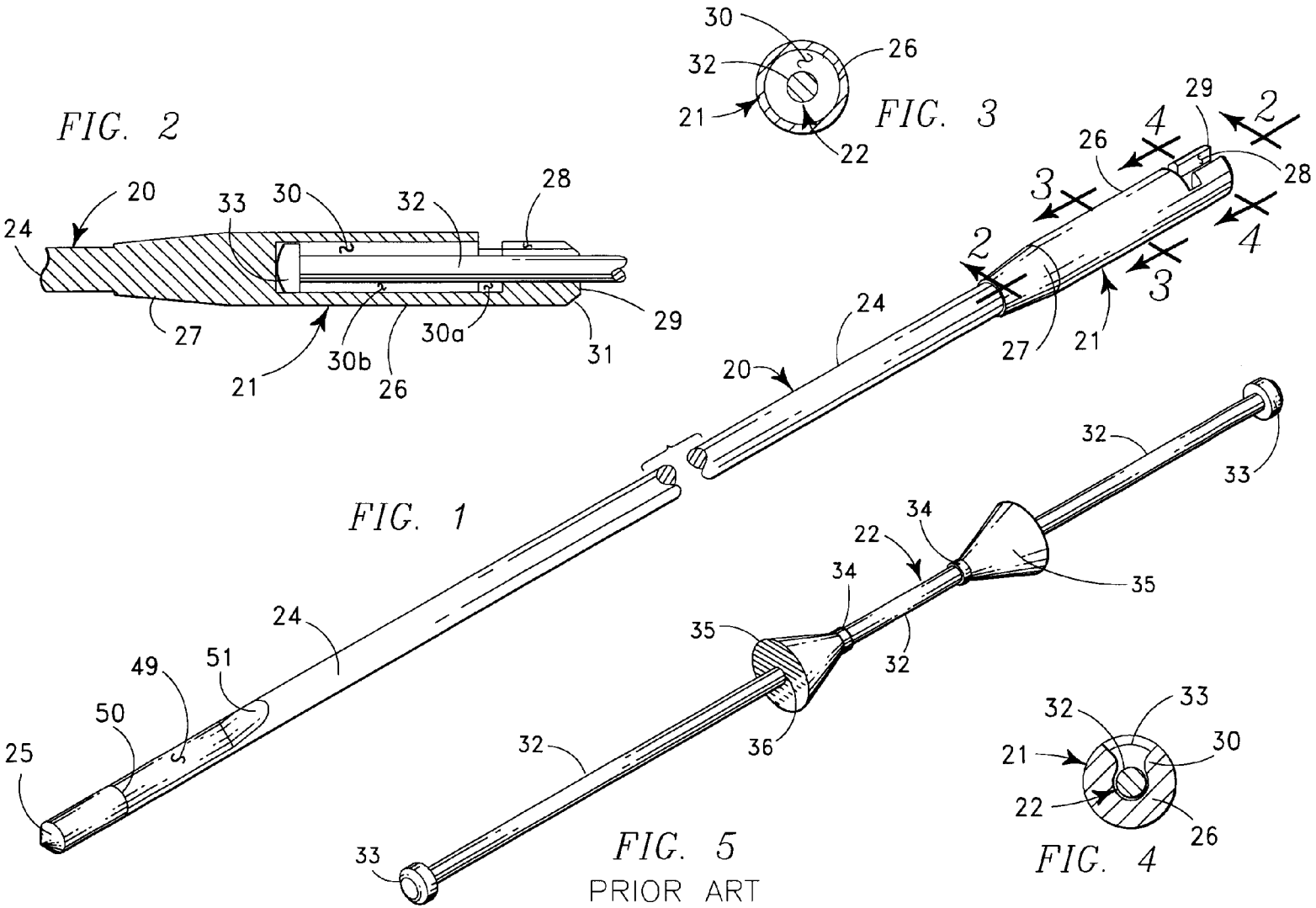
FIG. 5 PRIOR ART
FIG. 1 is an isometric view of a first species of our form tie extender.
FIG. 2 is a partial vertical elongate cross-sectional view through the connecting portion of the form tie extender of FIG. 1, taken on the lines 2—2 thereon in the direction indicated by the arrows, with a form tie shown in fastened position therein.
FIG. 3 is a vertical traverse cross-sectional view through the connecting structure of the form tie extender of FIG. 1, taken on the lines 3—3 thereon in the direction indicated by the arrows, with a form tie partially shown in fastened position therein.
FIG. 4 is a vertical traverse cross-sectional view through the connecting structure of the form tie extender of FIG. 1, taken on the lines 4—4 thereon in the direction indicated by the arrows, with a form tie shown in fastened position therein.
FIG. 5 is an isometric view of a typical form tie of common use in the present day concrete forming arts with which the form tie extender of FIGS. 1–4 is operative.

Our invention generally comprises a form tie extender having body 20 with connecting structure 21 at a second inner end to releasably interconnect the end portion of form tie 22 in form structure 23 to aid formation of the form structure.

Form tie extender body 20 provides elongate cylindrical rod 24 having pointed portion 25 at a first end and connecting structure 21 at a second end. The diameter of rod 24 is not critical, but must be small enough to allow passage through form tie holes defined in spacedly adjacent form panels it is to serve. Commonly most form tie holes are 0.625 inch in diameter.

Spacedly inwardly of end portion 25, rod 24 defines axially elongate form notch 49 having perpendicular outward wall 50 proximal to end 25 and inward, radially outwardly sloping wall 51. This notch is convenient, but not necessary, to aid in maintaining the end portion of rod 24 in a tie hole against accidental displacement once so placed. The length of rod 24 may vary, but must be such that when interconnected with form tie 22, operably carried by the first form panel of an adjacent cooperating pair of preliminarily positioned form panels, the form tie extender will extend into and through a cooperating form tie hole defined in the adjacent second form panel when the two form panels are spaced apart sufficiently that a worker may move and function therebetween. These requirements normally are met by a form tie extender with a rod having a diameter of approximately 0.375 inch and a length of between eighteen to thirty-six inches, though these dimensions are preferred only and not limiting.

Connecting structure 21 comprises cylindrical body 26, generally, but not necessarily, of somewhat larger diameter than cylindrical rod 24 and if of a different diametric size communicating with the cylindrical rod by truncated conic transition element 27 to provide a smooth transition surface that will not adversely affect insertion of the form tie extender in and through form tie holes. The peripheral portion of inner second end 29 of body 26, in the instance illustrated, defines chamfer 31 to avoid sharp edges on the extender. Tie channel 28 is defined in body 26 to extend in axially parallel orientation spacedly inwardly from inner second end 29 and radially inwardly to a point spacedly distant from the diametrically opposed periphery of the body. The tie channel 28 has a horizontal width appropriate to accept the end portion of a form tie body therein and may be configured so as to require some force to overcome friction or create slight resilient deformation of the body 26 to allow entry of the form tie completely into channel 28 to aid in fastenably maintaining the form tie in channel 28. The axially inner end portion of tie channel 28 communicates with somewhat radially larger, partially circumferentially enclosed form tie head channel 30 of appropriate size and configuration to receive a form tie head portion so that the end portion of the form tie may be inserted in a radial direction in portion 30*a* of the head channel and then moved axially into portion 30*b* of the head channel for releaseable interconnection with the form tie connecting structure.

The axial length of cylindrical body 26 of the connecting structure is not critical but must be sufficient to allow definition of form tie channels 28 and 30 with sufficient length to provide a stable releasable interconnection with the end portion of a form tie to be serviced which is preferably approximately two to four inches. The diameter of the cylindrical body must be such as to allow insertion in and passage through a form tie hole defined in a form panel to be serviced. Since such holes commonly are approximately 0.625 inch in diameter, preferably the diameter of the cylindrical body 26 is approximately 0.60 inch, though the minimum diameter of the body is regulated by the diameter of a form tie head to be carried by the form tie extender. The body 26 must be large enough to define a tie head channel 30 that will accept a tie head and yet leave sufficient material about the tie head channel to provide a stable and rigid connecting structure 21 for interconnection of the end portion of a form tie.

A type of form tie 22 with which the first species of form tie extender of FIGS. 1–4 is operative is illustrated in FIG. 5. This type of form tie, which is commonly used in both light and commercial construction, provides elongate rod-like tie body 32 having radially larger annular tie heads 33 at each end. Such form ties are generally formed to specific length for use in form structures that form a concrete panel of a particular predetermined thickness. Form tie body 32 carries annular, diametrically larger tie cone stops 34 spacedly inwardly from each tie head 33 to prevent the passage inwardly therepast of truncated conic tie cones 35 defining channels 36 to slidably receive the tie rod body 32. The tie cones 35 are used to define conic indentations in the surface of a concrete panel formed thereabout and through which the tie body 32 extends, so that after form removal the rod body 32 may be broken off in that indentation and the indentation subsequently filled if desired.

Such tie cones 35 are not necessary, but if used, the tie cone stops 34 are defined at appropriate distance from each other that the bases of the paired opposed tie cones, when the truncated apices of the cones are positioned against the associated stops, will be the same distance apart as the surfaces of the concrete panel to be formed. This allows tie cones to aid in positioning and maintaining form panels in properly spaced forming adjacency. The length of such form ties, between the inner surface of heads 33, is such as to allow the form tie body 32, when established in a form structure, to extend spacedly beyond each of the two adjacent opposed form panels so that the form tie heads 33 may be fastened on the external surfaces of the form panels, or on supports associated with those surfaces, by known releasable fasteners, commonly of a wedge type.

Figure 6:
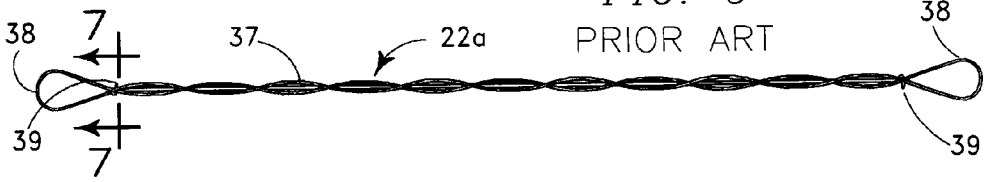
FIG. 6 PRIOR ART
FIG. 6 is a plan view of a twisted wire type form tie with looped ends that is in common use in the present concrete forming arts, with which the second species of form tie extender of FIGS. 8–10 is operative.

A second species of wire form tie 22*a* that is used particularly in forming thinner walls in light construction is illustrated FIG. 6. This form tie in the instance illustrated is formed from a single length of metal wire with body 37 formed by three twisted strands defining elongate loops 38 at each end of the tie with perpendicularly projecting wire ends forming perpendicularly extending panel stops 39 at the inner end portion of each loop 38. This type of form tie may have indentations (not shown) defined adjacent panel stops 39 to aid breaking of the outwardly projecting loops 38 from a concrete structure after form panels have been removed from the concrete structure. The distance between the distal portions of panel stops 39 is substantially the same as the thickness of a concrete panel desired to be formed. The widest dimension of loops 38 must not be greater than the diameter of tie holes predefined in form panels with which the ties are to be used and the length of the panel stops normally, but not necessarily, is about one half of the widest dimension of the loops to allow ready passage of the panel stops through tie holes in the forming panels carrying them.

Figure 7:
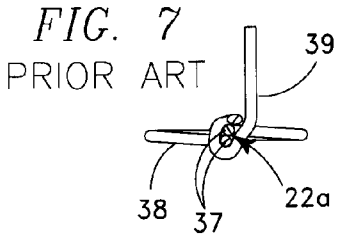
FIG. 7 PRIOR ART
FIG. 7 is a vertical traverse cross-sectional view through the left portion of the form tie of FIG. 6, taken on the line 7—7 thereon in the direction indicated by the arrows.
Figure 8:
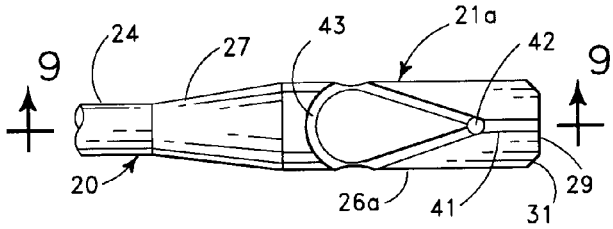
FIG. 8 is a partial plan view of the connecting end portion of a second species of form tie extender configured for use with the form tie of FIGS. 6–7.
Figure 9:
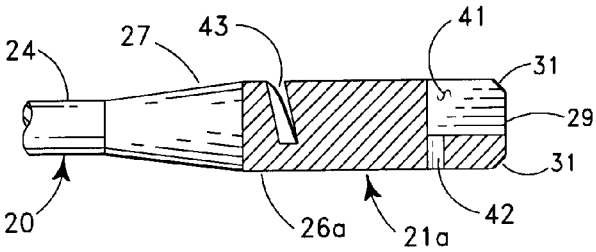
FIG. 9 is an elongate vertical cross-sectional view through the connecting portion of the form tie extender of FIG. 8, taken on the line 9—9 thereon in the direction indicated by the arrows.
Figure 10:
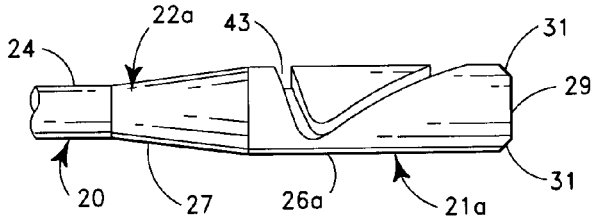
FIG. 10 is an elevational view of the connecting structure of the form tie extender of FIG. 8.

A second species of form tie extender having connecting structure 21*a* for use with the second form tie species of FIGS. 6–7 is shown in FIGS. 8–10, where it is seen to have the same cylindrical body 20 formed by body rod 24 as in the first species. Connecting structure 21*a* provides cylindrical body 26*a* with truncated conic transitional element 27 interconnecting the body and adjacent second end of the body rod 24. Tie body channel 41 extends axially inward a spaced distance from end 29 of the body 26*a* and in its inner end portion defines panel stop channel 42 to accept panel stop 39 of the form tie. Arcuate loop slot 43 is defined in body 26*a* to extend from the tie body channel 41 in an appropriate position and with appropriate configuration to receive and interconnect therein loop 38 of the form tie 22*a* to be carried in the fastening structure 21*a*. Optionally loop slot 43 may be angulated somewhat toward end 29 in a radially inward direction to aid fastening of a tie loop therein.

Figures 11, 12, 13, 14, 15, 16, 17:
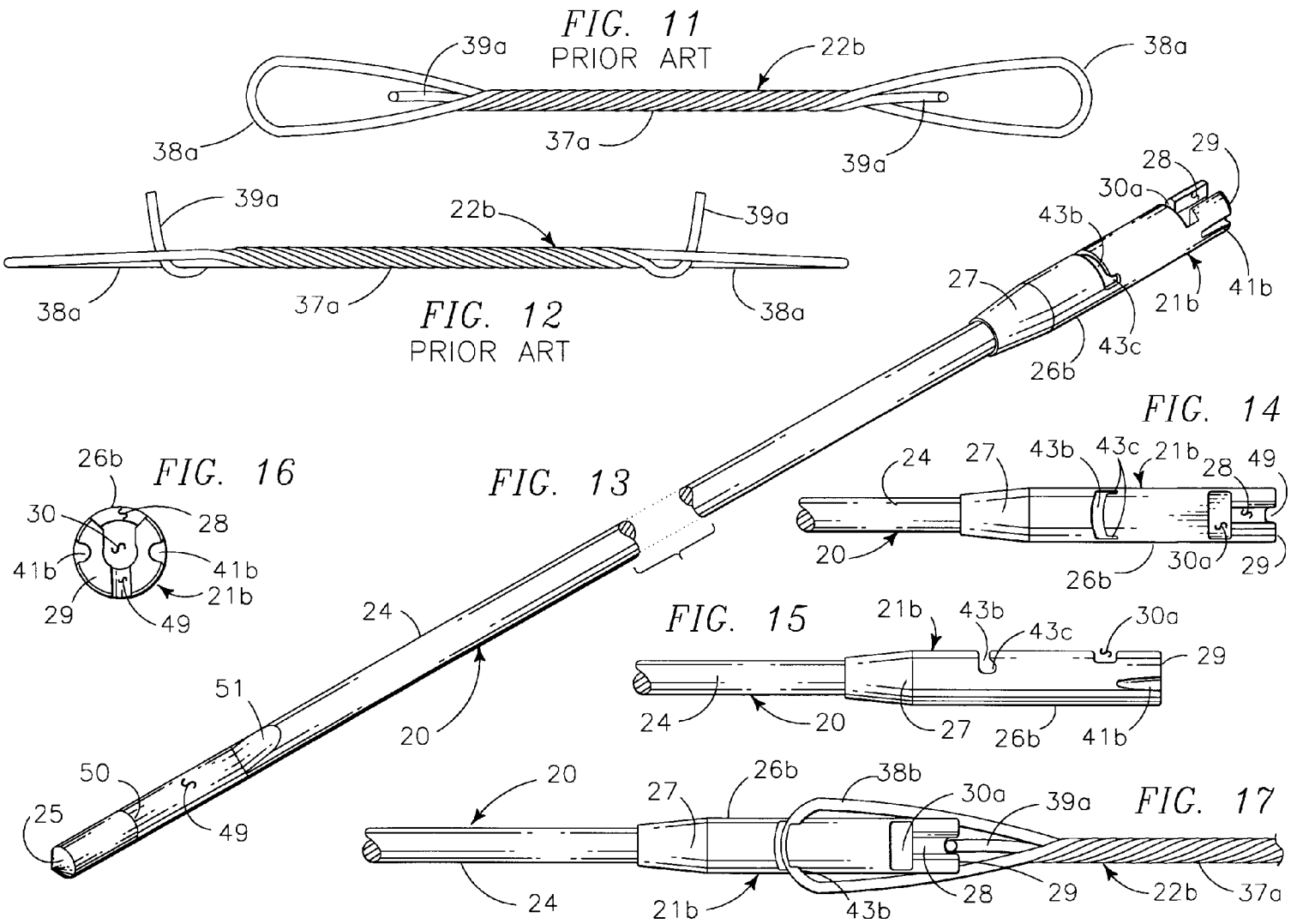
FIG. 11 PRIOR ART
FIG. 12 PRIOR ART
FIG. 11 is a plan view of a second type of commonly used twisted wire type of form tie.
FIG. 12 is an elevational view of the form tie of FIG. 11.
FIG. 13 is an isometric view of a third species of form tie extender for use with either the form tie of FIGS. 11–12 or the form tie of FIG. 5.
FIG. 14 is a partial plan view of the of fastening end of the form tie extender of FIG. 13.
FIG. 15 is a partial elevational view of the fastening end of the form tie extender of FIG. 13.
FIG. 16 is a right end view of the form tie extender of FIG. 13.
FIG. 17 is a plan view of the fastening end of the form tie extender of FIG. 13 with the end portion of the form tie of FIGS. 11–12 fastened therein.

A third species of twisted wire form tie 22*b* that is commonly used in modern concrete wall construction is shown in FIGS. 11–12. This form tie is formed similarly to the second species of FIGS. 6–7 with a metal wire body 37*a* comprising three twisted stands of a single length of wire with loops 38*a* at each end having panel stops 39*a* formed by the projecting wire ends at the inner end portion of each loop 38*a*. This third species of form tie differs from the second species, aside from configurational details, principally in the tighter twisting of the body 39*a* and the relative orientation of the opposed panel stops 39*a*.

A third species of form tie extender having connecting structure 21*b* for use with both the first and third form tie species of FIG. 5 and FIGS. 11–12 respectively is shown in FIGS. 13–17. This connecting structure 21*b* provides cylindrical body 26*b* with truncated conic transitional element 27 interconnecting the body 26*b* and adjacent end of the body rod 24. Tie body channel 28, and head channel 30 are defined in the body 26*b* in the same fashion as in the fastening head 21 of the first species of form tie extender of FIGS. 1–4 to fastenably accept the form tie 22 of FIG. 5.

Additionally cylindrical body 26*b* defines tie loop channel 43*b* in its medial inner portion with rearwardly extending notches 43*c* in the loop channel radially inner end parts to aid in positionally maintaining the looped end portion of the third species of form tie of FIGS. 11–12. The rearward end portion of body 26*b* defines similar, diametrically opposed loop grooves 41*b* extending in an axial direction spacedly inwardly from end 29 to receive and positionally maintain the inner portions of loop 38*a* of the third species of form tie. The two loop grooves 41*b* preferably are each approximately 90° from the middle of the tie loop channel 43*b*. The rearward end 29 of connector body 26*b* defines tie stop slot 49 extending radially outward from the rearward portion of tie channel 28 to receive tie stop 39*a*. The tie loop channel 43*b*, notches 43*c* loop grooves 41*b* and stop slot 49 are all configured and positioned to received the loop end portions 38*a*, 39*a* of the third species of form tie 22*b* in a releasably fastenable fit as illustrated in FIG. 17.

This third species of form tie extender may be used with either the first or third species of form tie and the second species of form tie extender may be modified in a similar fashion to allow use with both the first and second species of form ties. The connecting structures 21, 21*a* and 21*b* may be modified by routineers in the mechanical and engineering arts to accept fastening end structures of other form ties of differing configurations in releasable interconnection and such other connecting structure designs to interconnect other form ties are within the ambit and scope of our invention.

Figure 19:
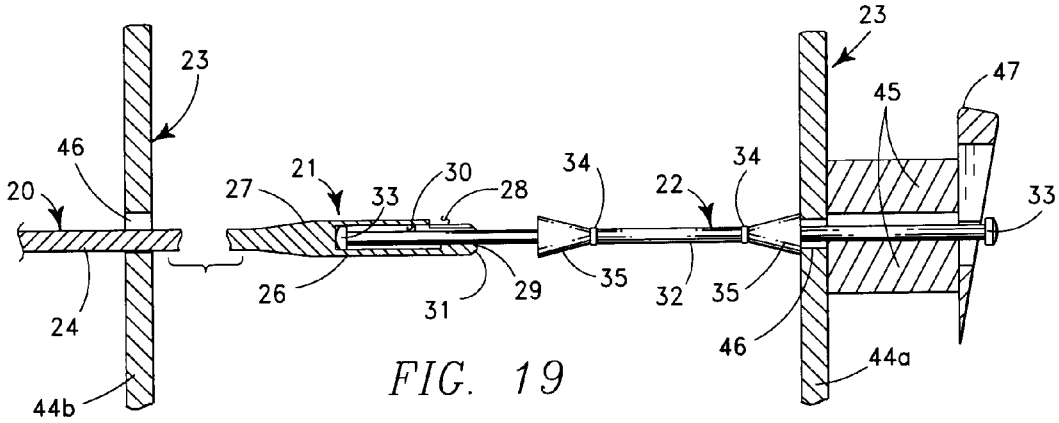
FIG. 19 is an enlarged partial vertical cross-sectional view through a form tie and interconnected form tie extender of FIG. 18, but with the form panels in position for assembly, taken on the lines 19—19 on FIG. 18 in the direction indicated by the arrows thereon.
Figure 18:
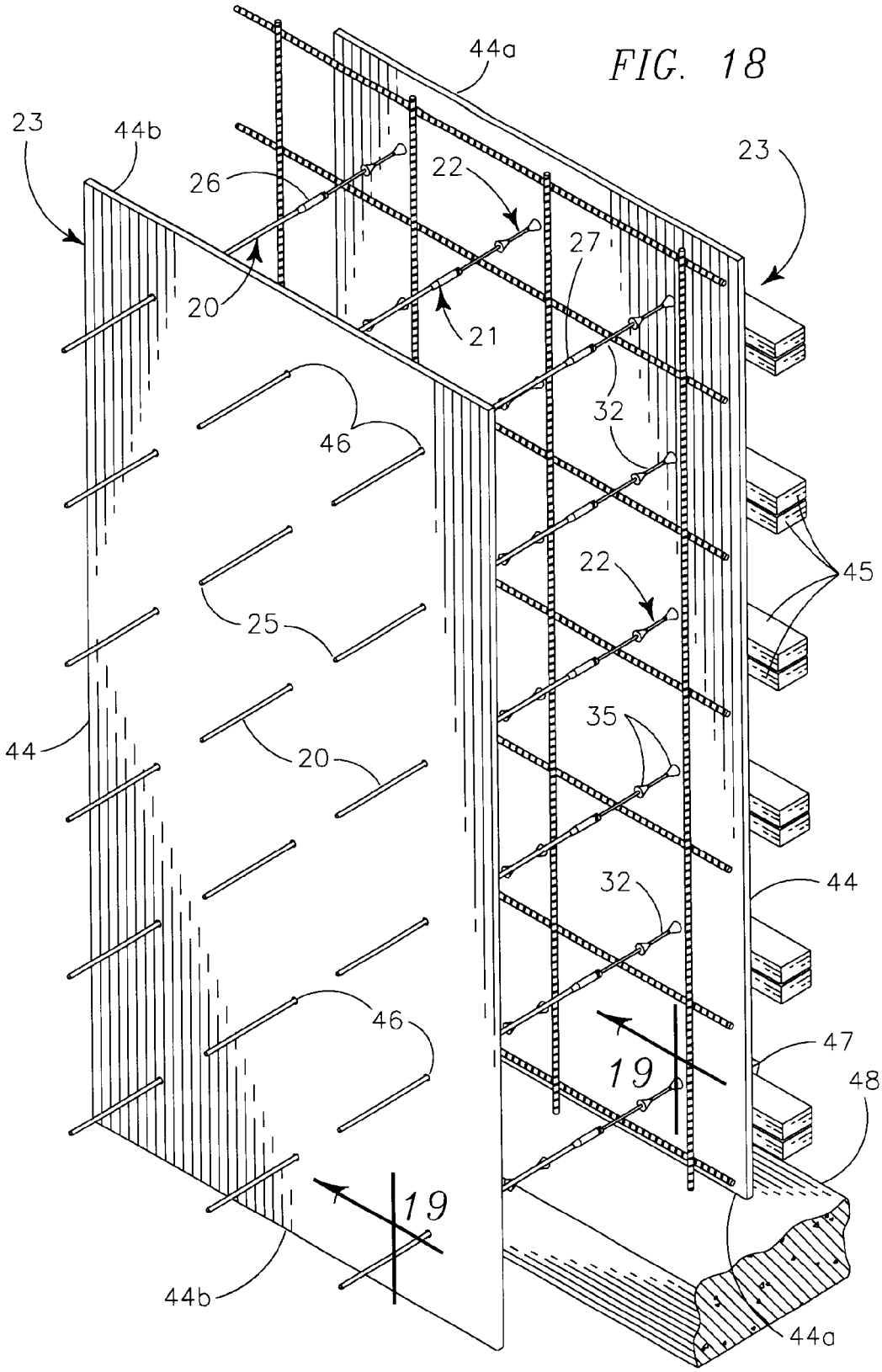
FIG. 18 is an isometric view showing use of our form tie extenders between two preliminarily spaced form panels.

Having described the structure of our invention, its use may be understood, particularly with reference to FIGS. 18–19 of the drawings.

Form structure 23 for forming the sides of a concrete panel (not shown), such as a vertical wall, commonly provide two similar spaced form panels 44*a*, 44*b* of some areal extent and often configured as rectilinear modules of not more than four by eight foot dimension to allow use of standard sized panels of building material. At least one of these panels, usually the outside panel 44*a*, commonly is strengthened and supported by whalers 45, either horizontally or vertically orientated on the exterior surface of the panel, and optionally by other support structure (not shown) communicating with the earth or other independent supports adjacent to the form structure. The form panels 44*a* and 44*b* each define a plurality of spaced form tie holes 46 arrayed in cooperating pairs with one of each pair in each form panel 44*a*, 44*b* to receive a form tie 22 therebetween. Commonly the form tie holes 46 are defined between some or all spacedly adjacent whalers or groups of whalers 45 so that the form tie heads 33 may be fastened on the outside of the frame panels to aid the fastening and structural integrity of the entire form structure.

Form ties 22 extend between the spacedly adjacent form panels 44*a*, 44*b* to provide tensile strength to hold the panels together, and generally prior to pouring a concrete structure to provide compressive support to maintain panel spacing. The tensile support is provided by fastening the form tie heads 33 on the exterior surface of the form panels, commonly by wedge-type fasteners 47 as illustrated in FIG. 19 and heretofore known in the concrete forming arts. The form panels 44 may be maintained in spaced relationship by tie cones 35, panel stops 39, 39*a* removable blocking (not shown) or other heretofore known means.

In assembling such form structures in the past, commonly footing 48, or a similar permanent support, was established in or on the earth and form panels 44*a*, 44*b* positioned and supported thereon in final spaced position to form the desired concrete structure. The form panels were positionally maintained by supports positioned in or on the earth or on other adjacent supporting structures. Form ties 22 were inserted in a first form panel, usually the outer panel 44*a*, from the inner side before placement of the second adjacent form panel, usually inner panel 44*b*, and the form ties were extended toward the paired cooperating holes 46 defined in the second inner form panel. The second form panel 44*b* then was moved into final position adjacent the first form panel 44*a* and the form ties then established through the form tie holes 46 defined in the second form panel 44*b*. Commonly because of the required fit of form ties in form panel holes 46 and the small distance between the panels, it was difficult to manipulate the form ties to insert them into a cooperating hole defined in the second form panel. Form tie insertion commonly was accomplished by a joint effort of two workers with one worker on the exterior of the first form panel 44*a* to move the form tie axially, and a second worker positioned at the vertical end of the inner panel 44*b* where he could use elongate tools to direct the positioning of the end portion of the form ties between the panels position for insertion into the cooperating form tie hole in the second panel 44*b*. This assemblage would be carried out in a form structure with both workers outside the space between the forms.

In some instances, form ties have been inserted from the space between two spaced finally positioned form panels firstly by moving one end of a form tie into a tie hole defined in a first form panel and then moving the second form tie end into a hole defined in the second form panel. This procedure, however, has not generally been followed in establishing form ties in form panels because it generally requires somewhat resiliently deformable form ties and tie deformation which make the process more difficult and time consuming than inserting the form ties by two workmen as hereinbefore described and does not provide the benefits of rigid form ties. With concrete forms for relatively thin concrete panels having a thickness of a few inches, form ties, especially of the first species, may not physically be insertable from between the form panels even with deformation.

To use our tie extenders in a form structure, such as illustrated in FIGS. 18 and 19, the first form panel 44*a* is established in proper forming position on footing 48. Form ties 22 are then inserted from the interior surface of the first panel 44*a* with a first end extended through a tie hole in the first panel and spacedly beyond the outer surface thereof and with the second end extending in the opposite direction away from the inner panel surface. The first end of each form panel then is fastened on the outer side of first panel 44*a* in the fashion heretofore known for such fastening. The second form panel 44*b* that is to form the opposed surface of a concrete structure is then established in a temporary position spacedly adjacent first form panel 44*a*, but at a distance sufficient to allow a workman to move in the space between the two panels, and yet less than the total combined length of a form tie and form tie extender connected therewith. The second form panel 44*b* need not necessarily be on the footing 48 and may be supported in the temporary position by any convenient means, but commonly is supported by a crane or similar machine so that it may be easily and quickly moved into final forming position when it is ready for this movement.

A workman then moves into the space between the panels 44*a*, 44*b*, positions the outer pointed end 25 of a form tie extender through a form tie hole 46 in the second panel 44*b*, and fastens to the form tie extender into releasable interconnection with the form tie 22 to be carried in the form tie hole 46 defined in the second panel 44*b* that is to carry that form tie, so that the interconnected form tie and form tie extender extend through and outwardly beyond each pair of form tie holes that ultimately are to carry the form tie. Form tie extenders are then positioned and interconnected with each form tie in the first panel 44*a* in similar fashion. The form notches 49 defined in the form tie extenders will tend to prevent the form tie extenders from moving out of tie holes in the second panel after their placement and during the remaining form construction process by catching on and engaging the outer form surface defining the tie holes.

After all form ties in the adjacent panels 44*a*, 44*b* have been placed, the workman exits from between the form panels and second inner panel 44*b* is moved toward outer panel 44*a* until the inner panel is in proper forming position spacedly adjacent panel the outer panel, while maintaining the interconnected form tie extenders and form ties in the paired cooperating holes that ultimately are to carry the form tie. The second form panel 44*b* is maintained and supported in its final position in the normal fashion heretofore known in the concrete forming arts. The form tie extenders now are on the outer side of the second panel 44*b*, and they are manually removed from the interconnected form ties by the workman while maintaining the tie in the tie hole defined in the second panel. The form ties then are fastened on the surface inner form panel 44*b* by fasteners 47, in the instance illustrated comprising slotted wedges. The interior form panel 44*b* is appropriately braced as heretofore known to complete the form assemblage. The form structure now is ready for forming plastic concrete in the traditional known fashion heretofore known.

From the foregoing description, it is to be noted that our form tie extenders and the method of using them may be adapted for use with form structures of various areal extent and spacings.

It is further to be noted that the form tie extenders and the process for their use require the efforts of only one workman, and that a single workman may accomplish positioning of form ties more simply and more rapidly than could be done in the past by two workmen using traditional methods heretofore known for such purposes.

The foregoing description of our invention is necessarily of a detailed nature so that specific embodiments of it might be set forth as required, but it is to be understood that various modifications of detail and rearrangement and multiplication of elements might be resorted to without departing from its spirit, essence or scope.

Having thusly described our invention, what we desire to protect by Letters Patent, and

What we claim is:

1. A process for assembling a concrete form structure, having spacedly adjacent first and second form panels, each with inner proximal and outer distal sides, interconnected by form ties with fastening structure at first and second ends, and extending through paired cooperating form tie holes defined in each form panel, by use of form tie extenders having an elongate body of cross-sectional configuration allowing passage through the form tie holes, a first end to aid passage into a form tie hole and a second end with fastening structure to releasably interconnect the fastening structure of a form tie, comprising:

supporting the first form panel on a support in position to form one side of the concrete form structure;

extending first ends of form ties from the inner side of the first form panel through predefined form tie holes in the first form panel and spacedly beyond the outer side of the first form panel for fastening on the first form panel;

fastening the first ends of the form ties on the outer side of the first form panel;

establishing a second form panel in a temporary position spacedly adjacent the first form panel, at a distance to allow a workman to move in the space between the form panels but less than the combined length of form ties and form tie extenders to extend between the form panels;

placing first end portions of form tie extenders in form tie holes predefined in the second form panel from the inner side of second form panel;

interconnecting second end portions of the form tie extenders with the form tie in the paired cooperating form tie hole defined in the first form panel by a workman moving in the space between the first and second form panels;

moving the second form panel toward the first form panel to a forming position adjacent the first form panel while maintaining the form tie extenders in the form tie holes in the second panel carrying them and in continued interconnection with the connected form ties;

supporting the second form panel in forming position;

removing the form tie extenders from the interconnected form ties from the outer side of the second form panel; and fastening the second ends of the form ties on the outer side of the second form panel.

2. A method for establishing form ties in a concrete form structure having spaced opposed first and second form panels, each with inner proximal and outer distal sides and defining a plurality of spaced tie holes arrayed in cooperating pairs in each form panel to cooperatively receive form ties having first and second ends therethrough, by use of elongate tie extenders having first and second ends with releasable form tie fastening means at the second ends and a configuration to pass through the form tie holes defined in the second form panel, comprising establishing a first form panel in forming position on a support for forming a concrete structure;

placing the first ends of form ties through form tie holes defined in the first panel and fastening the first form tie ends on the outer surface of the first form panel;

placing the second form panel in a temporary position spacedly adjacent the first form panel at a distance to allow a workman to move between the first and second form panels but less than the combined length of form ties and form tie extenders;

placing the first ends of form tie extenders through form tie holes defined in the second form panel and interconnecting the second ends of the form tie extenders with the second ends of form ties carried in the paired cooperating form tie holes defined in the first form panel, by a workman moving between the first and second form panels;

moving the second form panel into forming position spacedly adjacent the first panel while maintaining the form tie extenders in the form tie holes defined in the second panel; and removing the form tie extenders from the outer side of the second panel.

* * * * *